US005782723A

United States Patent [19]

Kuo

[11] Patent Number: 5,782,723

[45] Date of Patent: Jul. 21, 1998

[54] COLLAPSIBLE TREADMILL

[76] Inventor: Hai Pin Kuo, P.O. Box 82-144, Taipei, Taiwan

[21] Appl. No.: 925,637

[22] Filed: Sep. 9, 1997

[51] Int. Cl.[6] ..... A63B 22/02

[52] U.S. Cl. ..... 482/54; 422/51

[58] Field of Search ..... 482/51, 54

[56] References Cited

U.S. PATENT DOCUMENTS

| | | | |
|---|---|---|---|
| 931,394 | 8/1909 | Day | 482/54 |
| 5,662,557 | 9/1997 | Watterson et al. | 482/54 |
| 5,702,325 | 12/1997 | Watterson et al. | 482/54 |

*Primary Examiner*—Lynne A. Reichard
*Attorney, Agent, or Firm*—A & J

[57] ABSTRACT

A collapsible treadmill includes a base body and handle bars. The base body supports such basic components as an electric motor, front and rear shafts, a tread belt, a tread board. The base body includes a U-shaped frame and a rectangular main frame. The U-shaped frame is provided with pivot seats at their ends, while the main frame is provided with corresponding pivot plates at both sides of its front end. The U-shaped frame and the main frame are pivotally joined by screw bolts connecting the pivot seats and the pivot plates such that the main frame may be folded upwardly to rest between the handle bars when the treadmill is not in use so as to reduce floor-occupying space.

1 Claim, 5 Drawing Sheets

COLLAPSIBLE TREADMILL

BACKGROUND OF THE INVENTION

1. Field of the Invention

This invention relates generally to a treadmill, and more particularly to a treadmill which can be collapsed in two steps so as to occupy less floor space.

2. Description of the Prior Art

Treadmills are popular exercising apparatus. However, due to their size they occupy more floor space than such exercising apparatus as rowers, steppers, and exercise bikes. For city dwellers whose living space is limited, it is a problem to install a treadmill at home.

It is, therefore, desirable to have a treadmill which is collapsible so as to save floor space when not in use.

SUMMARY OF THE INVENTION

This invention relates generally to a treadmill, and more particularly to a treadmill which can be collapsed in two steps so as to occupy less floor space.

A primary object of the present invention is to provide a collapsible treadmill which may be folded to facilitate placement and storage when it is not in use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
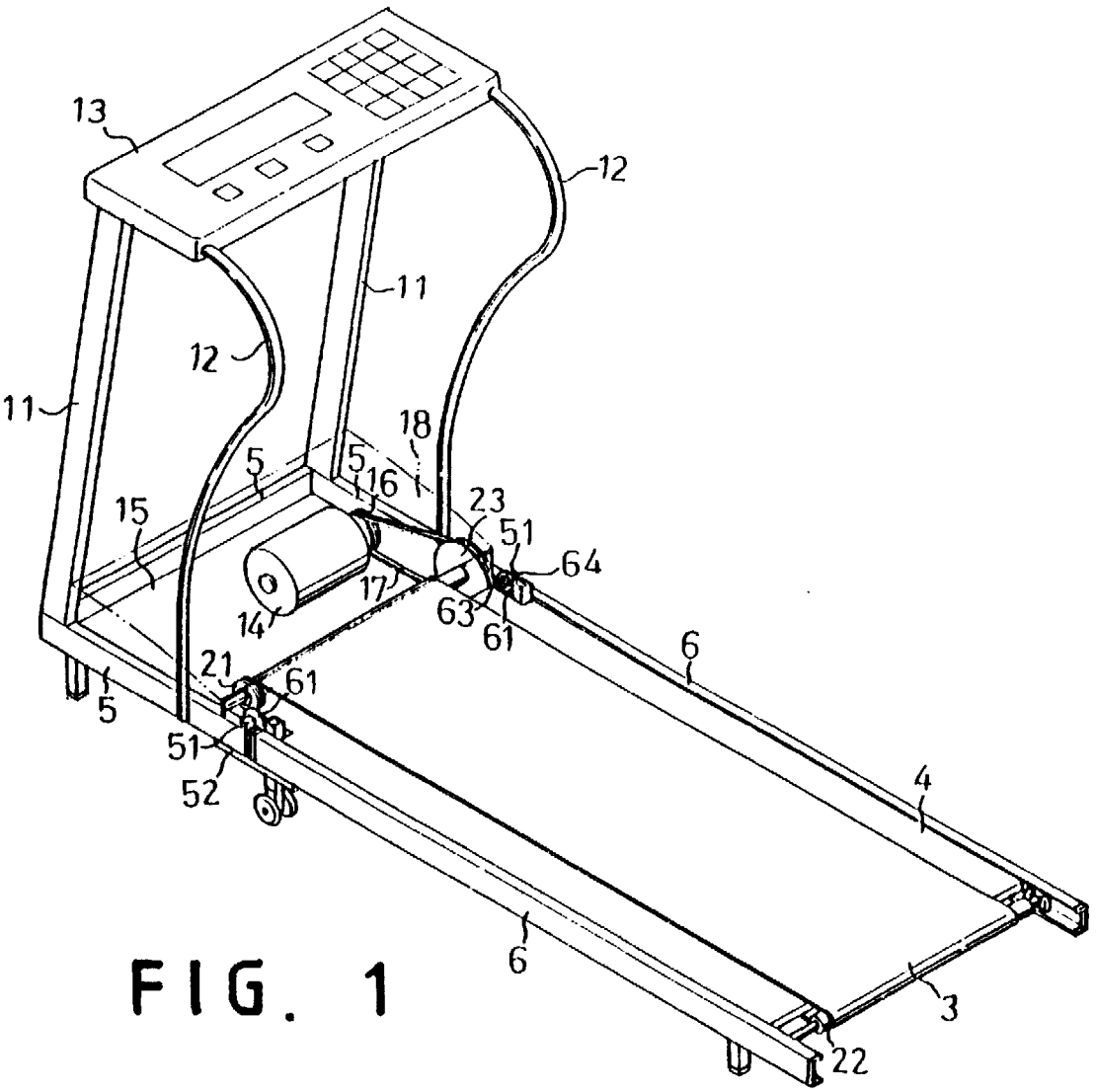
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

The basic structure and operation of existing treadmills and the treadmill of the present invention are described hereinafter with reference to FIG. 1. A treadmill essentially comprises a substantially rectangular base body B having a front portion and a rear portion, an upright frame 11 and two handle bars 12 extending from the front portion of the base body B. The handle bars 12 are provided for holding by the user. The present invention further comprise a dashboard 13 disposed at upper ends of the handle bars 12, a bottom plate 15 disposed at the front portion of the base body B to secure an electric motor 14. The base body B is provided with a front shaft 21 and a rear shaft 22 both of which are rotatable, and a rotary tread belt 3 connected to the front and rear shafts 21, 22. The rotary tread belt 3 includes a tread board 4 surrounded by the tread belt 3 and positioned on the base body B. The treadmill also comprises a cover 18 to cover the motor 14 and the front shaft 21. A transmission belt 17 is provided to connect a wheel 16 at an output shaft of the motor 14 and a driven wheel 23 of the front shaft 21. When the motor 14 is actuated, due to the transmission belt 17, the driven wheel 23 is rotated so that the front shaft 21 rotates synchronously therewith to cause the tread belt 3 to perform rotary movement. The user stands on the tread board 4 and runs to try to keep up with the speed of the tread belt 3.

Figure 6:
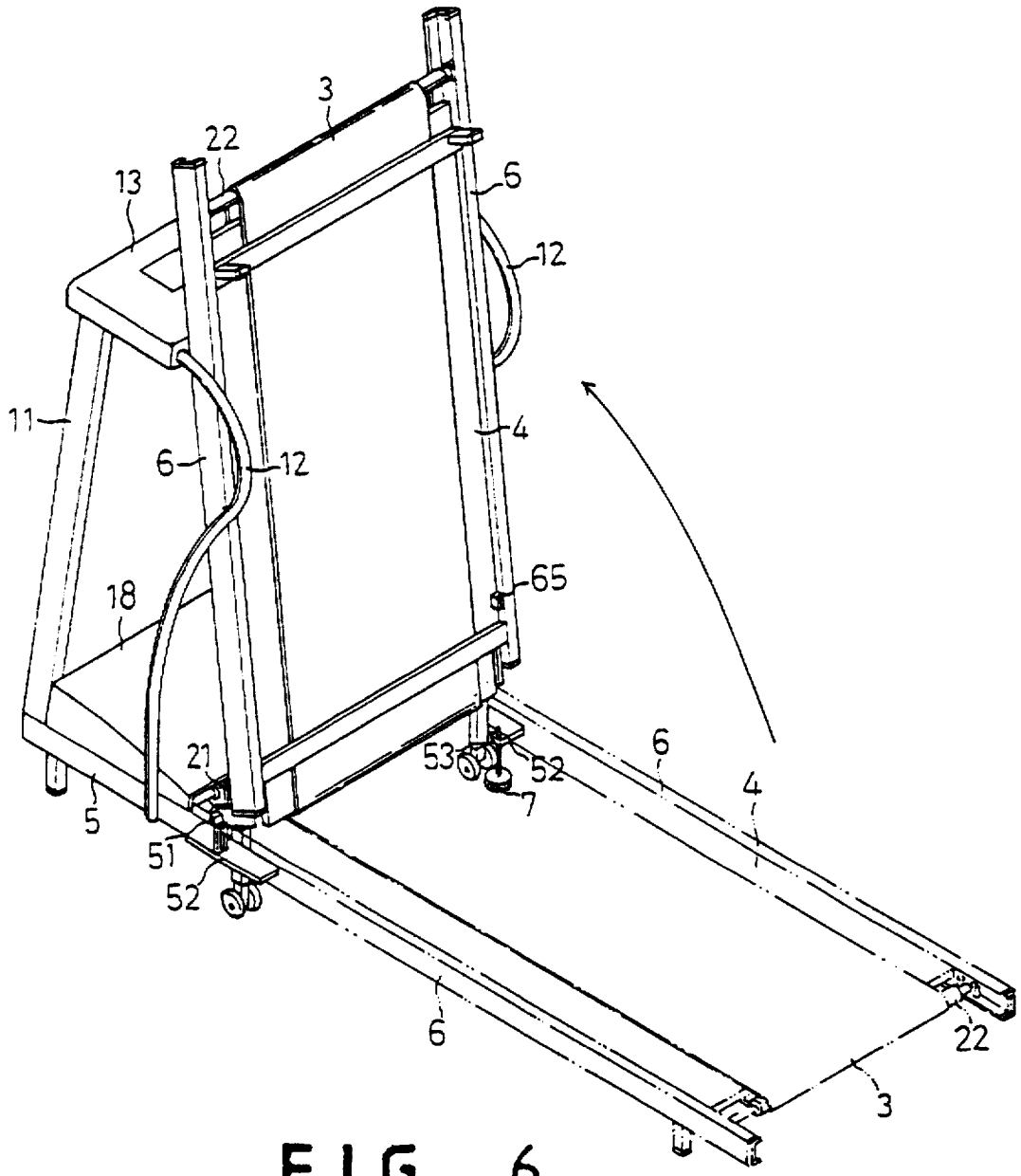
FIG. 6 shows a main frame of the present invention in a collapsed state.

As the base body B is horizontally placed on the floor, it will occupy a relatively large space. The treadmill of the present invention allows the user to collapse the treader into a relatively small structure so that it is less space-occupying. FIG. 6 illustrates the treadmill of the invention in a collapsed state.

Figure 2:
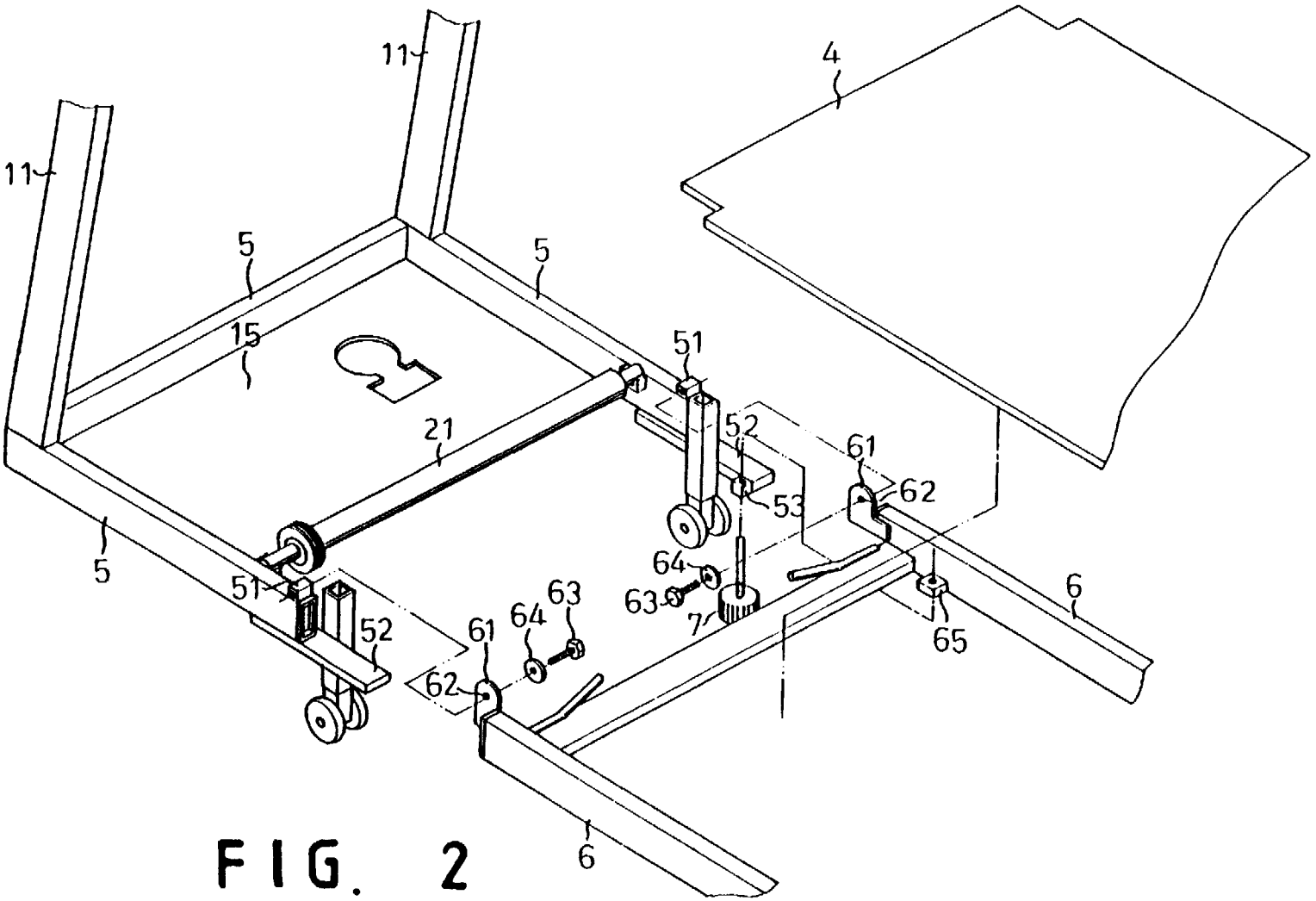
FIG. 2 is an exploded view of a base according to the present invention.
Figures 3, 4:
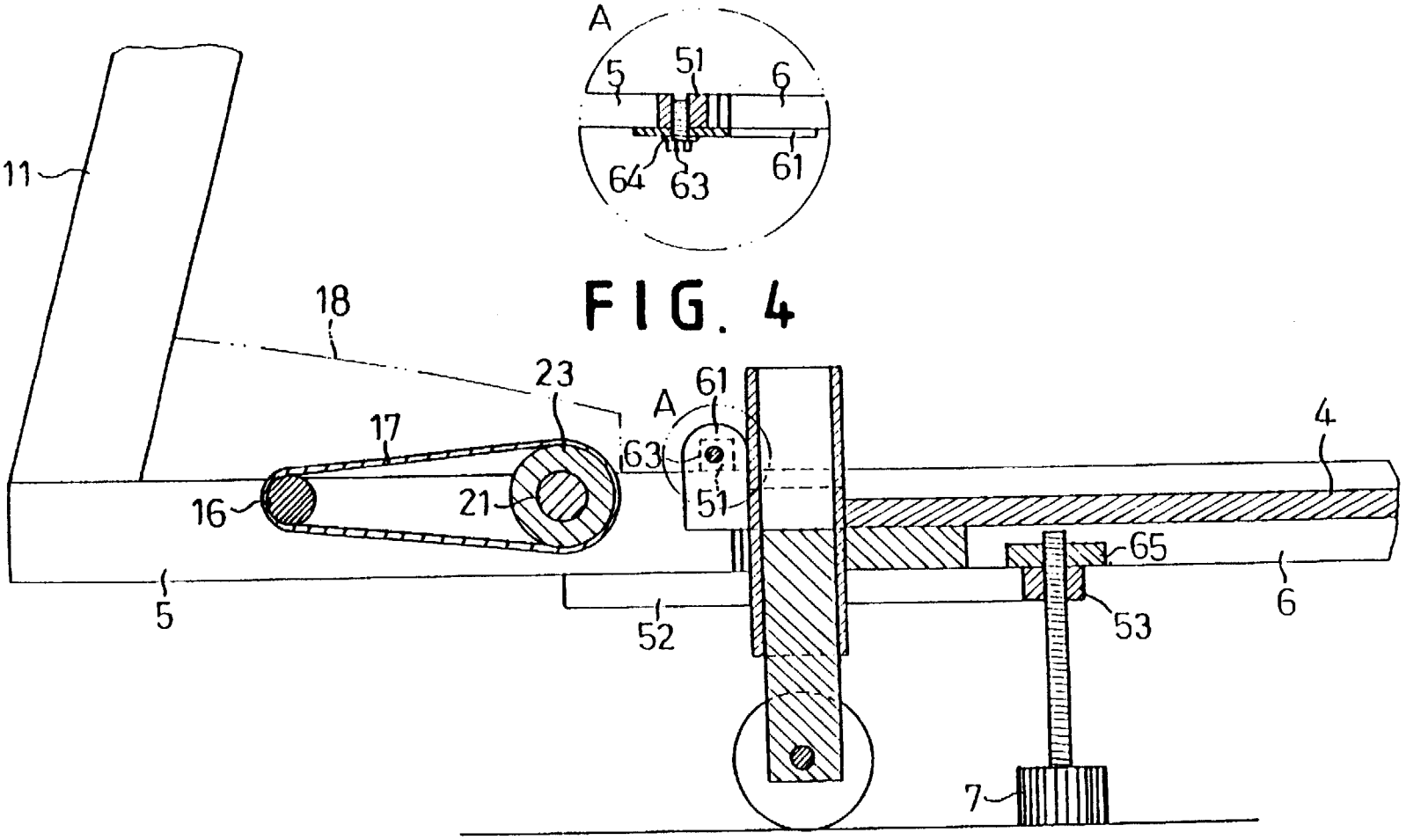
FIG. 3 is a sectional view of the base of the present invention.
FIG. 4 is an enlarged view of a part A in FIG. 3.
Figure 5:
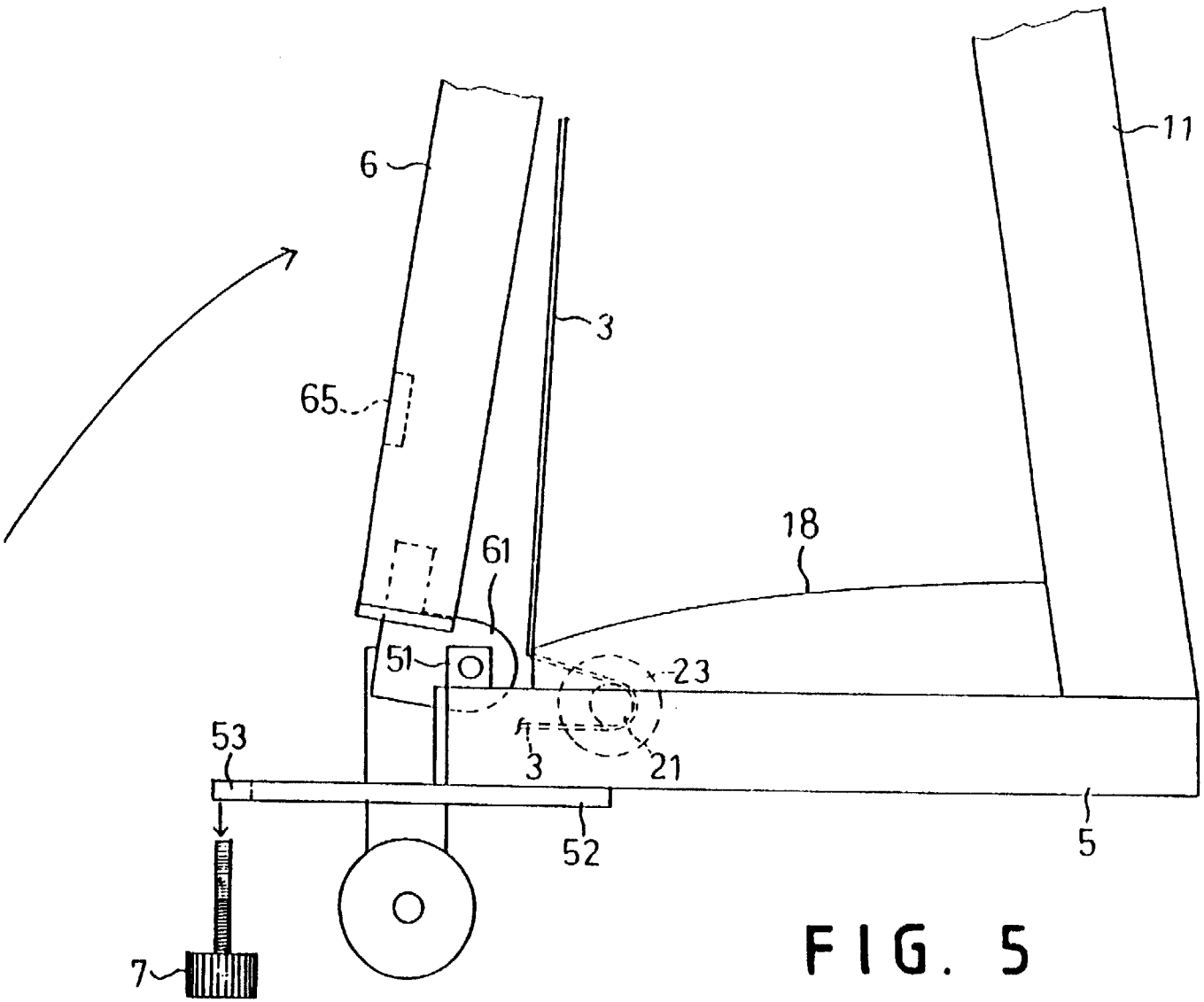
FIG. 5 is sectional view of the present invention, illustrating the operation of the base.

Referring to FIGS. 2 to 4, the base body B of the treadmill of the invention between the front shaft 21 and the tread board 4 is designed to be movably collapsible. The base body B comprises a U-shaped frame 5 and a main frame 6. A pivot seat 51 having a threaded hole is provided at the end of each arm of the U-shaped frame 5. The main frame 6 has two side portions and front and rear portions. It is provided with two L-shaped pivot plates 61, which are respectively disposed at an inner side of upper ends of the side portions. The pivot plates 62 have pre-formed round holes 62. In order to connect the main frame 6 to the U-shaped frame 5, screw bolts 63, being first passing through respective packing rings 64, are inserted into the round holes 62 of the respective pivot plates 61 of the main frame 6 and then into the threaded holes of the corresponding pivot seats 51 of the U-shaped frame 5. In order that the main frame 6 may bear the load of the user and provide stability during use, two extension bars 52 may be provided to extend respectively from the bottom sides of the ends of the arms of the U-shaped frame 5. Each extension bar 52 is provided with a positioning seat 53 with a threaded hole. On the other hand, the main frame 6 is provided with two positioning blocks 65 having a threaded hole near the respective pivot plates 61 for matching the positioning seats 53 of the U-shaped frame 5. A support seat 7 with a screw rod is used to fasten each positioning seat 53 to its corresponding positioning block 65. Therefore, the main frame 6 will maintain a reasonable stability during use and will not cause the base body B to shake.

In use, the treadmill of the invention occupies a large floor space just like existing treaders. But when it is not in use, the user may release the support seats 7 from the positioning seats 53 and their corresponding positioning blocks 65 so that the main frame 6 may be folded upwardly to lie against the dashboard 13 and between the handle bars 12, as shown in FIGS. 3, 4, 5 and 6. The treadmill of the invention therefore occupies less floor space. Besides, after folding, the entire treader is supported on the floor by the U-shaped frame 5. As the motor 14, the dashboard 13, and the handles 12 are all located at the U-shaped frame 5, which is hence the heaviest portion of the entire treadmill, the treader is firmly and stably supported.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A collapsible treadmill comprising:

a base body being substantially rectangular and having a front portion and a rear portion;

an upright frame disposed at said front portion of said base body;

two handle bars; and a dashboard disposed above said handle bars;

said front end of said base body being provided with a bottom plate and an electric motor positioned on said bottom plate, said motor having a wheel at an output shaft thereof;

said base body further having a rotary front shaft having a driven wheel, a rotary rear shaft, a rotary type tread belt fitted between said front shaft and said rear shaft, a transmission belt connecting said wheel of said motor and said driven wheel of said front shaft so that when said motor is actuated, said tread belt rotates to allow a user standing on said tread belt to perform running exercises, wherein said base body comprises a U-shaped frame and a main frame having two side portions and front and rear portions, said U-shaped frame having respective pivot seats at both ends thereof, and said main frame having respective L-shaped pivot plates at respective inner sides of respective front ends of said side portions, said pivot seats of said U-shaped frame and said pivot plates of said main frame being connected by screw bolts so that said main frame may be folded upwardly to lie against said dashboard and between said handle bars with said U-shaped frame supporting the weight of said treadmill, thereby said treadmill occupies relatively small floor space when not in use.

* * * * *